US005517779A

United States Patent [19]

Coleman

[11] Patent Number: 5,517,779

[45] Date of Patent: May 21, 1996

[54] SIGN FACE ATTACHMENT WITH PERIMETER FLANGES FOR UNIVERSAL MOUNTING

[76] Inventor: Kelly R. Coleman, 516 Belle Isle Ave., Belleair Beach, Fla. 34635

[21] Appl. No.: 446,098

[22] Filed: May 19, 1995

Related U.S. Application Data

[63] Continuation of Ser. No. 57,966, May 7, 1993, abandoned.

[51] Int. Cl.[6] ..... G09F 17/00

[52] U.S. Cl. ..... 40/603; 160/328; 160/378

[58] Field of Search ..... 40/603, 604, 574; 160/328, 378; 38/102.1, 102.2, 102.91; 248/215, 225.2, 301, 303, 304; 24/343, 598.3

[56] References Cited

U.S. PATENT DOCUMENTS

| | | | |
|---|---|---|---|
| 618,221 | 1/1899 | Buzzard | 24/343 X |
| 1,026,085 | 5/1912 | Faupel | 248/48.1 |
| 1,897,418 | 2/1933 | Carlson | 160/378 X |
| 2,651,483 | 9/1953 | Ritchie et al. | 24/343 X |
| 3,026,580 | 3/1962 | Lundgren | 24/343 X |
| 4,265,039 | 5/1981 | Brooks . | |
| 4,979,714 | 12/1990 | Russell et al. | 248/303 |
| 5,042,182 | 8/1991 | King | 40/603 |
| 5,143,335 | 9/1992 | Frankel | 248/301 X |

*Primary Examiner*—Brian K. Green

*Attorney, Agent, or Firm*—Edwin E. Greigg; Ronald E. Greigg

[57] ABSTRACT

A sign face frame structure for universal mounting on generally a vertically extending support. The body of the sign face frame is simple to manufacture and is formed of extruded aluminum bar stock in a manner to have a rigid mounting flange or leg surrounding the sides and bottom of the perimeter of the face frame, the flange being also provided for attaching the sign to the support. The sign face frame includes a semi-circular member to interfit with a receiver of various mounting designs. This semi-circular receiver may be incorporated into a sign base frame embodiment as an appendage or it may be provided as an independent part to be attached to a sign frame or building for the installation purposes of a sign face. The semi-circular receiver is designed for supporting the full weight of the face frame during installation until such time that sides and bottom mounting flanges or legs are attached or mechanically fastened to add relief to the weight bearing or attachment bond of the assembly. The assembled sign is fully sealed against the elements and may be illuminated by suitable devices preferably positioned within the inside of the body of the sign.

8 Claims, 10 Drawing Sheets

SIGN FACE ATTACHMENT WITH PERIMETER FLANGES FOR UNIVERSAL MOUNTING

This is a continuation of application Ser. No. 08/057,966 filed on May 7, 1993, now abandoned.

BACKGROUND OF THE INVENTION

This invention is directed to a sign face frame and more particularly to a sign face frame which can be secured to a wall of a building, or to an existing sign which includes an integral flange to assist in assembly of a sign.

This invention is an improvement over U.S. Pat. No. 4,488,368 which is directed to a sign with a perimeter flange for universally mounting a sign face. The patent allowed for a single sided sign frame containing a face that could be universally mounted to buildings, structures and was later adopted fore, use as an attachment to sign base frames. The drawback of the identical mounting flanges on all sides of the structure was the alignment in the field which was cumbersome.

In the advertising industry the use of display devices including those being interiorly illuminated and which are either permanently or temporarily mounted at a given location are, of course, very well known in the art. The particular configuration or construction of the sign utilized in any given advertising application depends upon such things as type of business goods or services being advertised, location in which the sign or display device is to be located and the particular segment of the public to which the advertisement is directed. Because of these many diverse applications there is of course a demand for various types of signs. This demand for such a wide variety of sign structures necessarily raises the cost of production and also that of maintenance since many of the signs utilized today have to be made to :individual specifications.

Other disadvantages inherent in the production and use of custom made signs includes the cost involved in installing these signs which frequently equals or exceeds the actual production cost. Since up to the present time no one single sign structure has had the versatility to satisfy the wide variety of advertising needs, the installation of the varying sign structures would also have to be done on a custom installation type basis. Since a custom built sign was normally utilized and adapted to a particular location and application workers involved in installing these custom made structures would often times be dealing with completely different types of structures of which they had no general knowledge or experience. Because of the above factors, the time and expense involved in installing these prior art sign face structures is relatively great.

Large scale or mass production of a substantially standard display device capable of being applied to various uses is, of course, highly desirable in that this type of manufacturing serves to lower the cost of production. Maintenance of a standard type sign will also be less expensive since repair or servicing of such a sign could be done on a replacement part type basis. However, as pointed out above the diverse application for which these face frame signs are needed and used normally would prevent a sign structure from being mass produced. For this reason, mass production of a generally standard type sign, which is to effective for various applications, has been relatively unknown in the advertising industry. In devising production methods for producing such signs, labor, production time and necessary equipment are all prime factors. In addition, the ultimate appearance of the sign itself must always be kept in mind.

One of the most important structural features of any sign is of course, the display face used for advertising of the various services or goods. Naturally, the display face itself is what is primarily observed by the public. It can therefore be seen that the production of a display face which would be adapted to fit various sign structures and which itself is aesthetically pleasing yet eye catching, could greatly reduce the cost of "customized" sign structures. Such face frame, if available, could be applied to almost any of the conventionally designed prior art structures available today.

Because of these and other commonly known problems prevalent in the advertising and sign making industry, there has been a long felt need for a display face device incorporating a display face which is versatile enough to be adapted to a number of various advertising structures. At the same time, such a display device and display face structure must include a relatively simple, low cost construction capable of being easily maintained and transported to any given location. Ideally, such a structure would be of somewhat standard type construction which is capable of being built through the application of mass production techniques. In addition, the versatility of such a structure would include its being readily used for various applications while at the same time being capable of efficiently and aesthetically advertising any desired subject matter.

SUMMARY OF THE INVENTION

The improved sign face frame attachment has been designed with a semi-circular feature to be incorporated into the sign frame display and to also be provided in a multitude of retrofit parts enabling an installer of the sign frame or face frame to purchase a frame with the semi-circular feature or purchase a retrofit part with the semi-circular feature.

The sign face frame is attached to a building, a structure or a sign box to hang the complete assembled face frame allowing free hands by the installer to attach the sides and bottom of the face frame assembly. This technique speeds up or lessens the installation time and also provides a system for use with either rigid or flexible faces which may be fitted into a frame and shipped or taken to the jobsite in tact and thereby installed to any structure in a minimum amount of the time with increased accuracy thereby reducing cost.

It is a principal object of this invention to provide a rugged sign face frame adapted to be universally mounted and supported on a support means.

Another object of the invention is to provide a sign frame having integral flange means for supporting the frame on a suitable support and carrying a sign cover.

Another object of the invention is to utilize an extruded rod stock having integral flanges for forming a face frame for a sign face.

Another object of the invention is to utilize an extruded aluminum rod shape that may be formed into a sign frame having a protruding flange for mounting the sign on the support means and inwardly directed flange means for supporting display panel means on one or both sides of the sign or to incorporate a receiver to accept flexible sign face substrates in lieu of rigid substrates.

DETAILED DESCRIPTION

Figure 1:
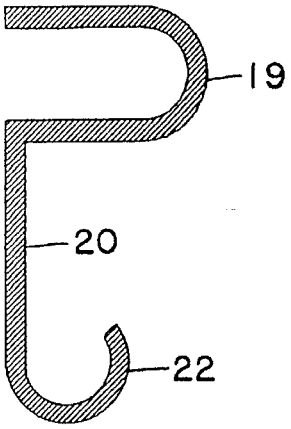
FIGS. 1–3 illustrate a cross-sectional view of three different types of sign frame attachments which are to be mounted flush on a wall surface and which have integral flanges.
Figure 2:
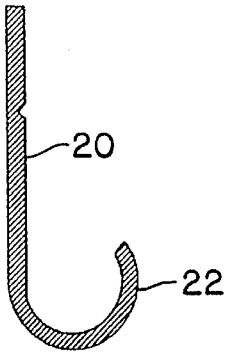
Figure 3:
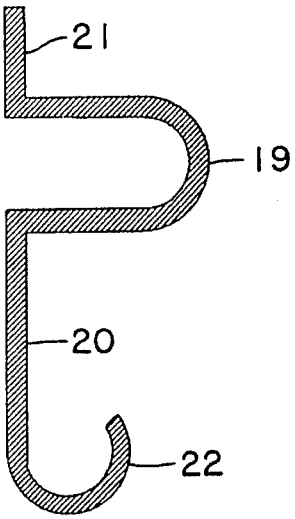

FIGS. 1–3 illustrate cross-sectional views of three different sign face structures which can be extruded aluminum and secured to a wall of a building or to a sign frame to which a sign facing may be easily hung onto the sign face structure. The sign face structures include an elongated main body portion 20 which can be secured to a structure and an integral flange portions 22 or semi-circular receiver on which a sign facing frame may be hung by use of a matching flange. Different shaped extensions may extend from the main body portion so long as the extension does not extend backwards beyond the main portion.

FIG. 1 illustrates a U-shaped portion integral with the main portion. The U-shaped extends in the same direction as the flange relative to the main body portion in which the U-shaped portion extends along the length of said sign face structure along a line which is parallel with a line along the semi-circular receiver end. FIG. 2 illustrates the attachment having only the main body portion and the protruding flange which is shown in a somewhat reversed "J" configuration. FIG. 3 is the same as FIG. 1, except that an end 21 extends upward from the U-shape and in alignment with the main body portion.

Figure 4:
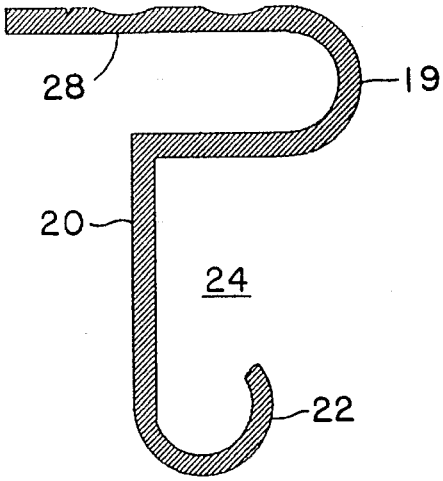
FIGS. 4 and 5 illustrate a cross-sectional view of two different types of sign frame attachments which are to be secured to a sign frame and which have integral flanges.
Figure 5:
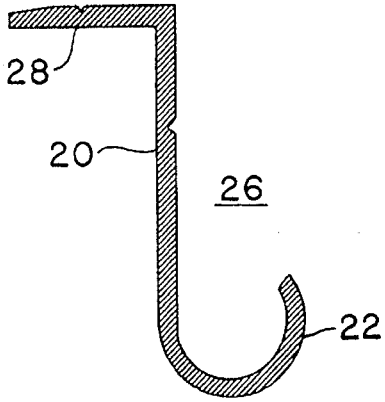
Figure 16:
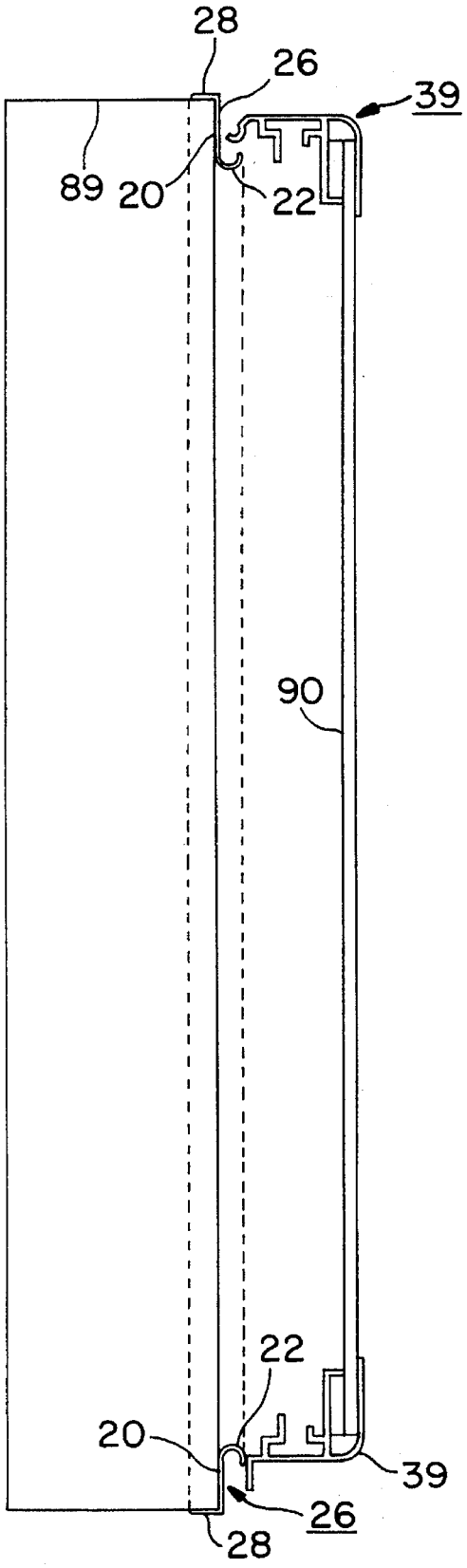
FIG. 16 illustrates a cross-sectional view of an attachment such as shown in FIG. 5 connected to a sign frame with an extruded frame such as shown in FIG. 8 secured thereto.
Figure 17:
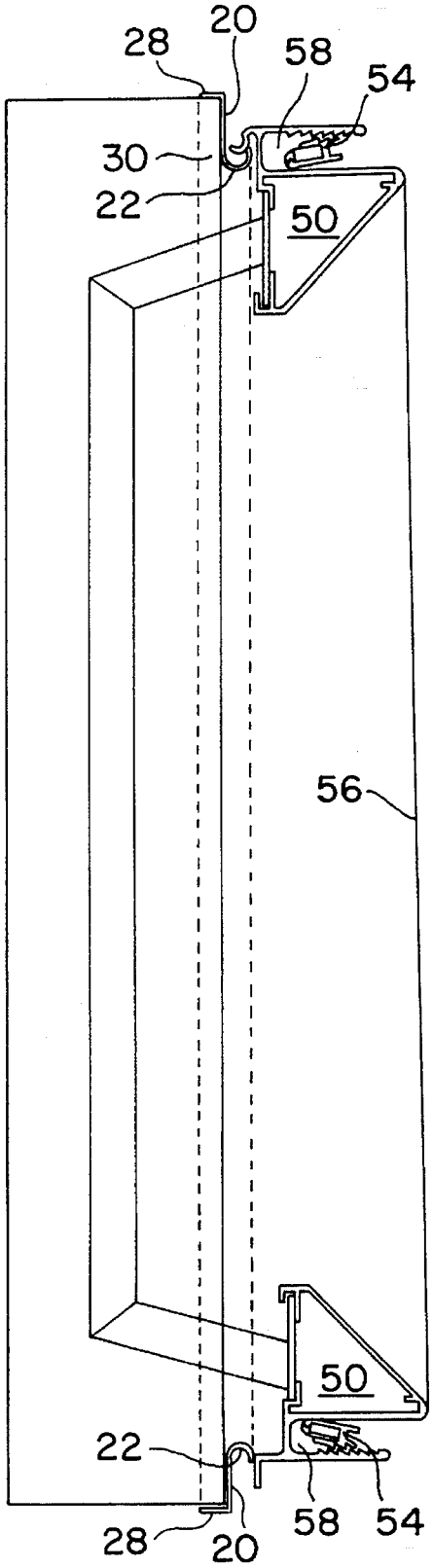
FIG. 17 illustrates a cross-sectional view of an attachment as shown in FIG. 5 secured to a sign frame with an extruded sign frame as shown in FIG. 10 secured thereto.

FIGS. 4 and 5 illustrate a cross-sectional view of a bullnose retrofit type 24 and a straight retrofit type 26. As shown, each of the attachments include a main body portion 20 and a flange 22 or semi-circular receiver. The main body portion has an extension with a portion 28 that extends back beyond the main body in a plane parallel with the flange portion. The portion 28 is secured above a sign frame facing 30 such as shown in FIGS. 16 and 17. FIG. 4 includes a U-shape which protrudes from the main body in a direction of the flange and an extension that protrudes backward from the main body in a plane parallel with the flange.

Figure 6:
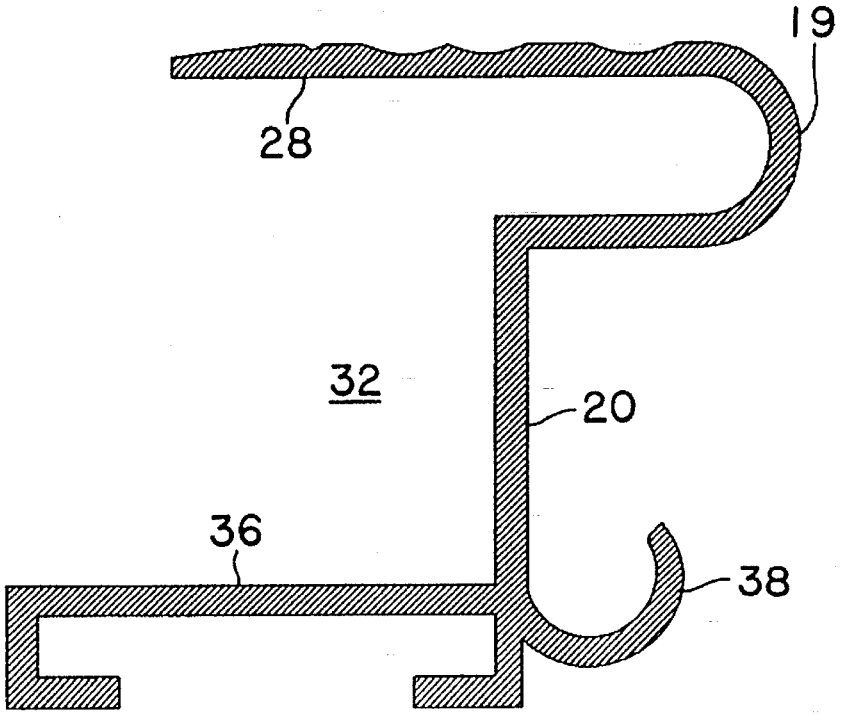
FIGS. 6 and 7 illustrate a cross-sectional view of different extruded aluminum C-Channels each with an integral flange.

FIGS. 6 illustrates a different type of extruded C-Channel frame 32. The extruded frame 32 is the same as the attachment shown in FIG. 4 except that the assembly in FIG. 6 includes an extra bottom support 36 which is integral with the main body opposite the flange 38.

Figure 7:
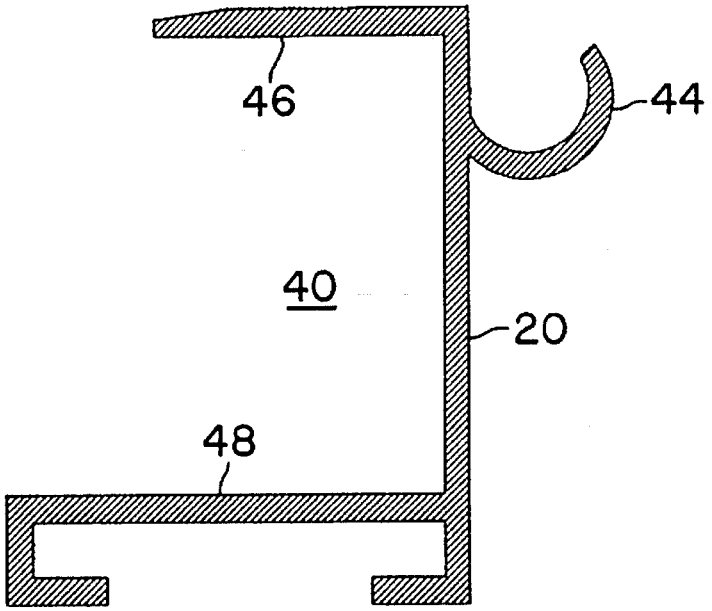
Figure 19:
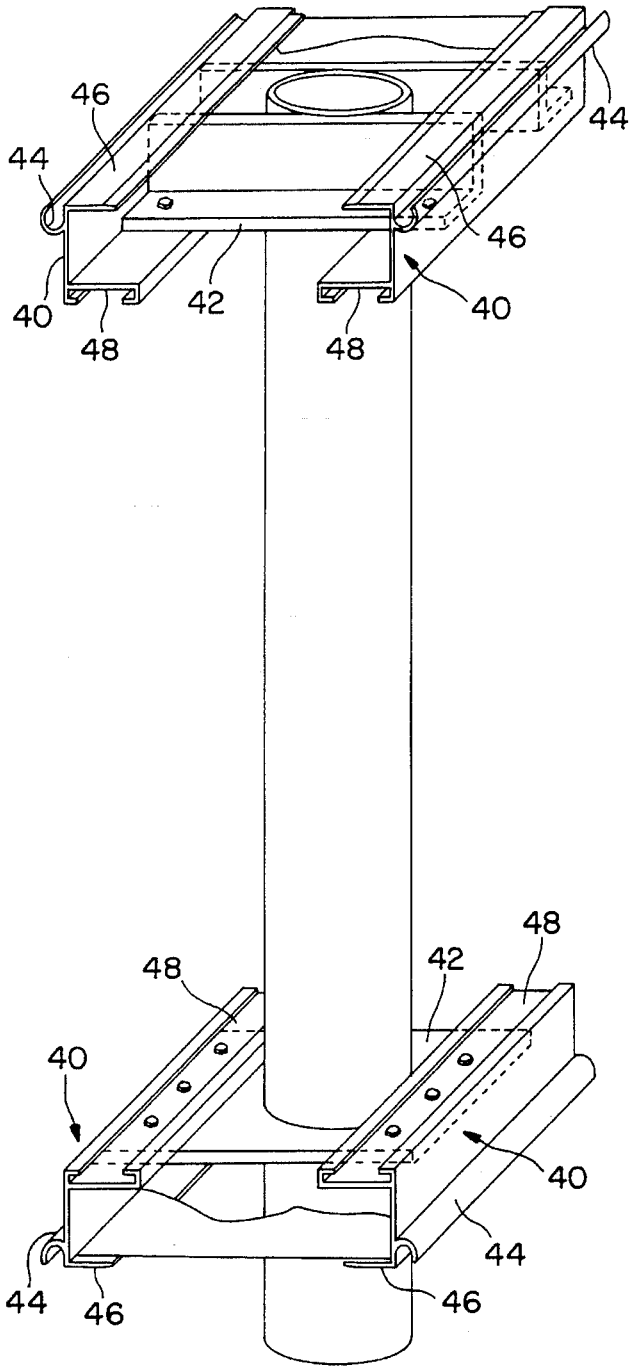
FIG. 19 illustrates a sign with a center pole with an extruded frame such as shown in FIG. 6 secured thereto shown in perspective.

FIG. 7 illustrates a flush type of extruded frame 40 which can be secured to a sign frame 42 such as shown in FIG. 19. The extruded frame 40 includes a flange 44 near the upper outward extension 46 and includes a bottom support 48 which is parallel with the extension 46.

FIGS. 1–7 illustrate cross sections of different modifications of extruded aluminum sign facing hangers which can be secured to a wall or to a sign frame from which an extruded aluminum sign face frame that supports a sign facing may be easily hung for installation of the sign facing.

Figure 8:
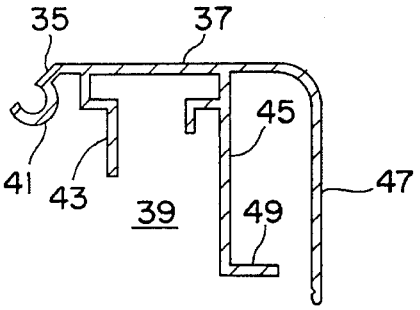
FIG. 8 illustrates a cross-sectional view of an extruded rigid radiused frame having an integral flange.
Figure 22:
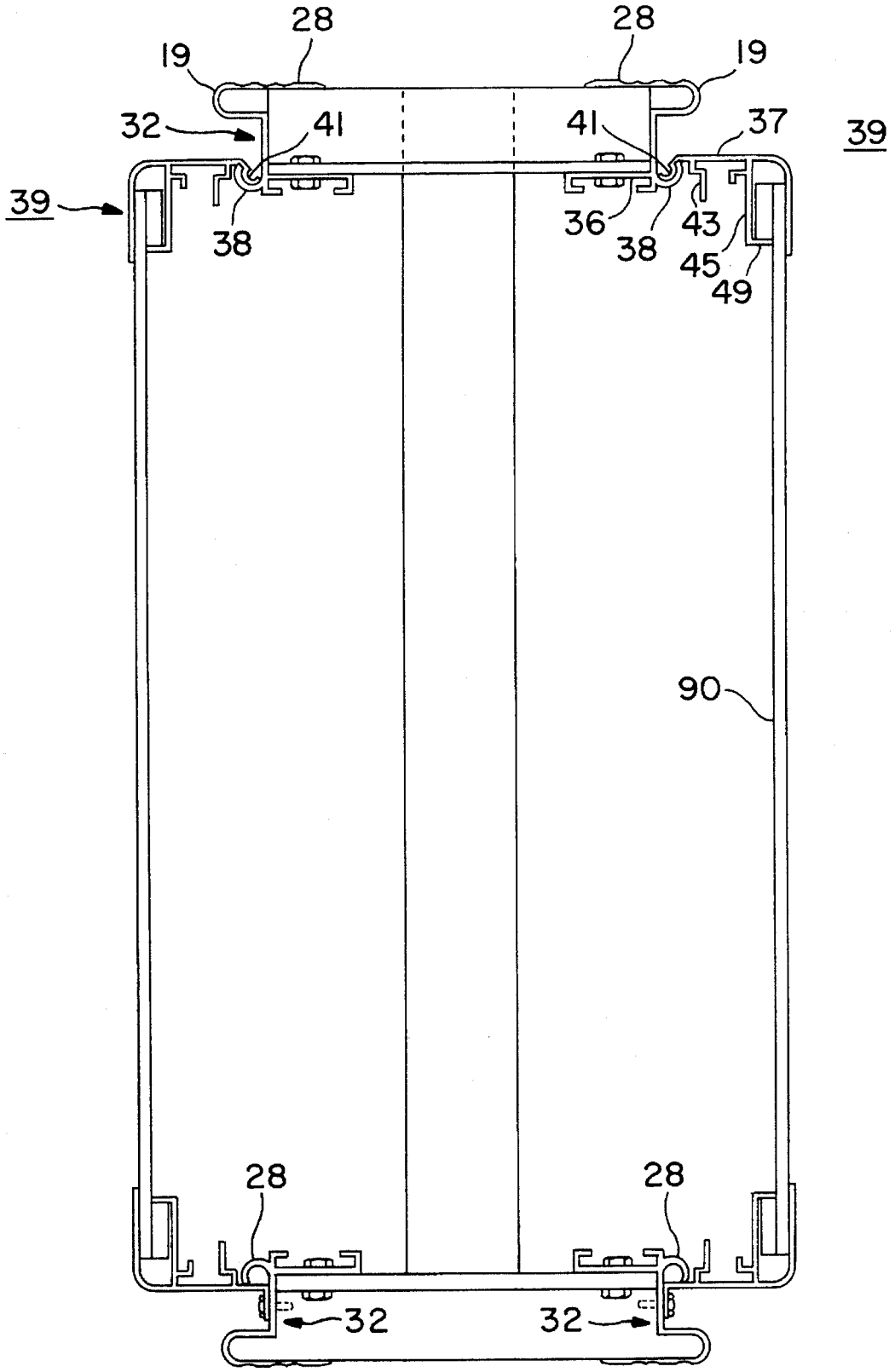
FIG. 22 illustrates a cross-sectional view of a sign frame formed with an extruded frame attachment as shown in FIG. 6 with an extruded frame such as shown in FIG. 8 secured thereto.

FIG. 8 illustrates a cross sectional view of an extruded aluminum sign face frame 39 having a downwardly sloping arm 35 from which a semi-circular hanger 41 is integral therewith. The sloping arm 35 extends from a central support 37 which has downwardly extending appendages 43 and 45 perpendicular thereto. The central support 37 extends to a 90° radiused end 47 that extends downward. The appendage 45 has a 90° end piece 49 that extends toward the end 47. The area included between the appendage 45, end 47 and end piece 49 form an area in which one end of a sign facing is secured as shown in FIG. 16. The semi-circular hanger 41 is shown supported by the flange 22 of a sign frame hanger, as shown in FIG. 5, which is secured to the sign frame. As shown in FIG. 22, the extruded aluminum sign face frame of FIG. 8 is hung from a sign face support as shown in FIG. 6.

Figure 9:
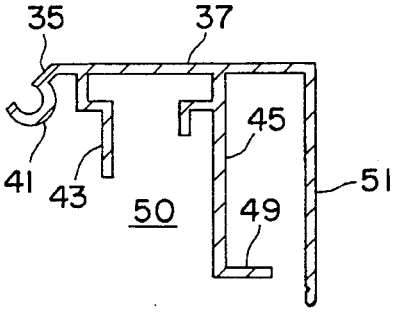
FIG. 9 illustrates a cross-sectional view of an extruded rigid frame having an integral flange.

FIG. 9 shows an extruded aluminum sign face frame 50 which is similar to the extruded aluminum sign face frame 39 except the end 51 corresponding to the end 47 is not radiused at 90° but rather is at a perpendicular to the central support.

Figure 23:
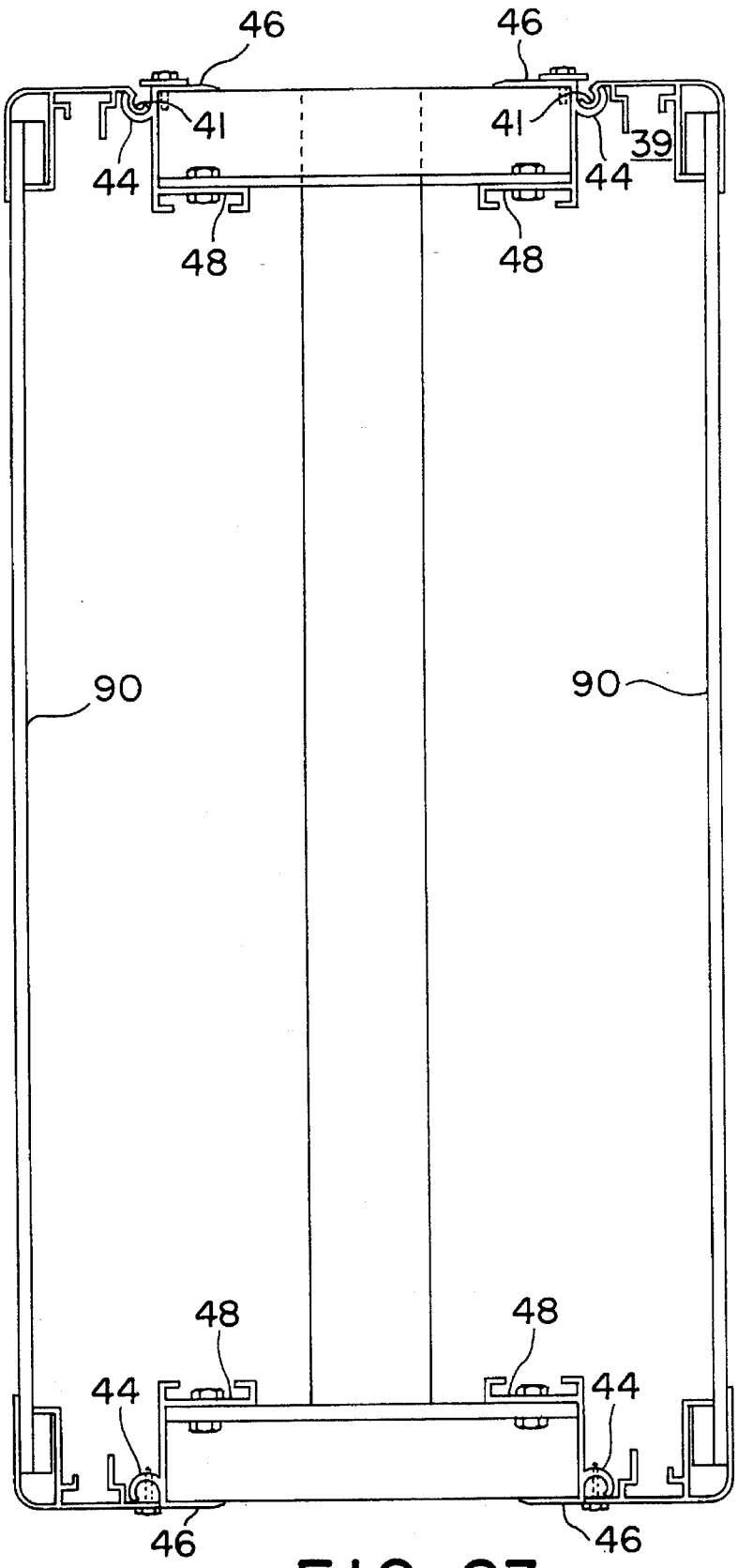
FIG. 23 illustrates a cross-sectional view of sign frame having a C-Channel frame such as shown in FIG. 7 secured thereto with an attachment such as shown in FIG. 8 secured to the C-Channel frame.

The sign face frames shown in FIGS. 8 and 9 can be used for supporting a rigid sign face or a flexible sign face in which their end is fixed in the area between the appendage 45 and end 47 by any suitable means as shown in FIGS. 16, 22 and 23.

Figure 10:
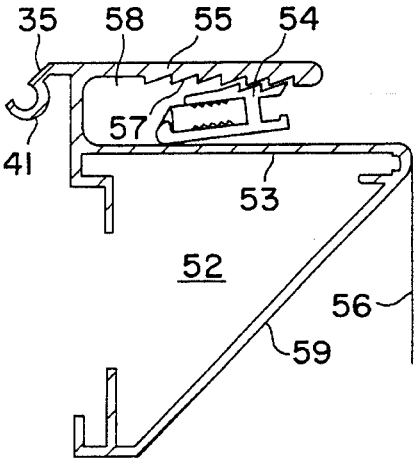
FIG. 10 illustrates a cross-sectional view of a bleed flex extruded channel having an integral flange.
Figure 11:
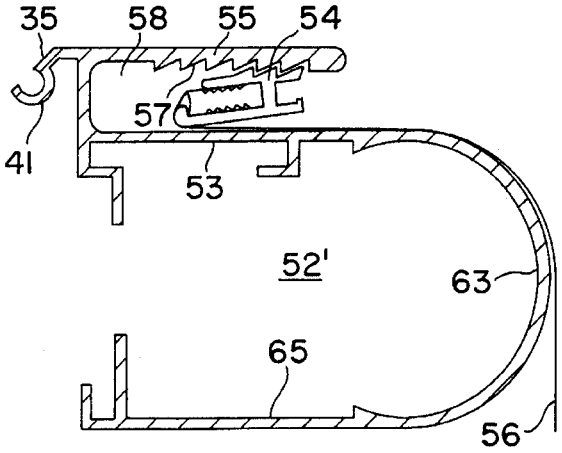
FIG. 11 illustrates a cross-sectional view of a bullnose flex extruded channel with an integral flange.

FIGS. 10 and 11 illustrate a different type of sign face frame from that shown in FIGS. 8 and 9. FIGS. 10 and 11 include the same type hanger 35, 41 as shown in FIGS. 8 and 9. FIG. 10 illustrates a cross-sectional view of a bleed flex sign frame 52 which includes a triangular main body portion and an upper U-shaped portion which includes a common face 53. An upper face 55 of the U-shaped portion includes sloping teeth 57 which slope toward the hanger 41. The triangular main body portion includes a front face 59 sloped at an angle with the common face 53.

FIG. 11 includes a hanger 35, 41 and upper U-shaped portion such as shown in FIG. 10. The difference between FIGS. 10 and 11 resides in the shape of the front face. The front face 63 of the extruded frame 52' of FIG. 11 is shaped as a semi-circle with the upper portion of the semi-circle joined with the common face 53 and the bottom of the semi-circle face is joined with a bottom face 65 parallel with the common face 53.

Figure 18:
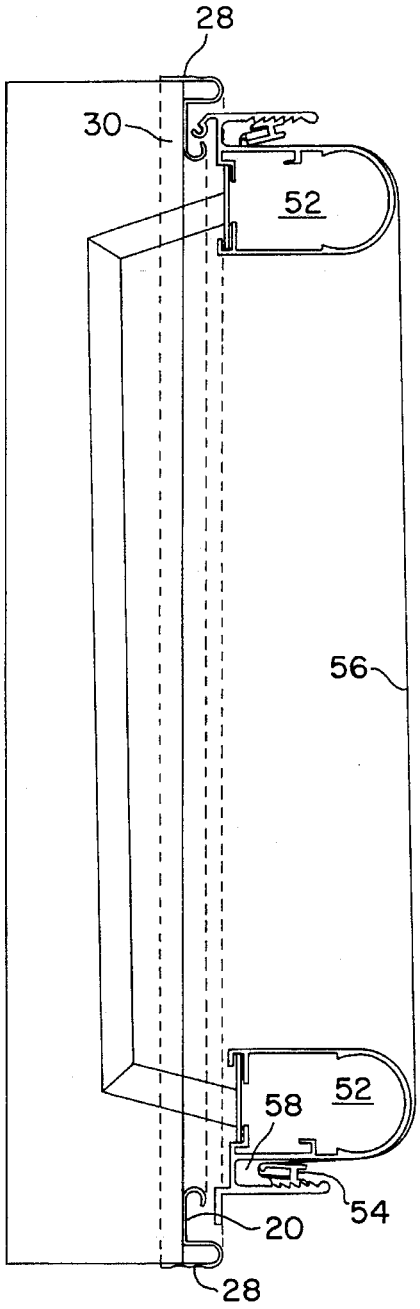
FIG. 18 illustrates a cross-sectional view of a sign attachment as shown in FIG. 4 secured to a sign frame with an extrusion such as shown in FIG. 12 secured thereto.

The sign face frames shown in FIGS. 10 and 11 are shown with a tensioning device 54 which secures an edge of a flexible sign face 56 within a receiving retainer 58. These sign frames are shown in FIGS. 17 and 18 secured to attachments as shown in FIGS. 5 and 4, respectively.

FIGS. 12–15 illustrate different extruded sign frames which incorporate one of the sign hangers set forth in FIGS. 1–7.

Figure 12:
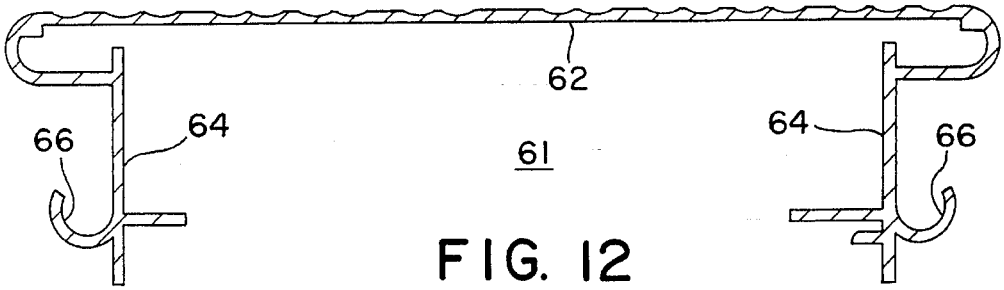
FIGS. 12–15 illustrate cross-sectional views of different types of extruded sign frames each of which have one or two integral flanges.

FIG. 12 illustrates a cross-sectional view of a sign frame 61 illustrating a closed top piece 62 which includes side pieces 64 which include outwardly extending flanges 66. A sign facing can be secured to each of the flanges with a light between the faces to form a sign.

Figure 13:
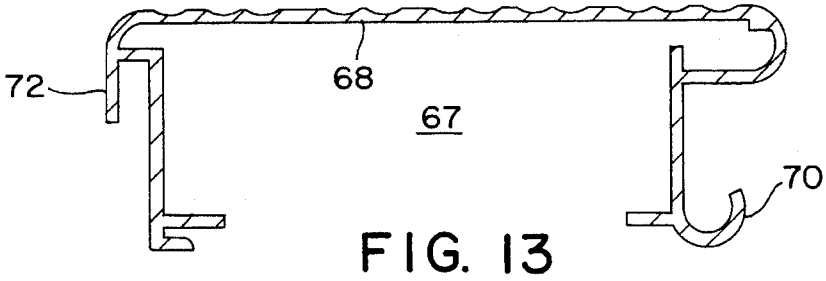

FIG. 13 illustrates a bullnose flush wall extruded sign frame 67 having a closed top 68 with one end having a flange 70 upon which a sign facing can be hung. The opposite end has a downward extending piece which can be hung over a strip secured onto a wall so that the sign can be secured flush to a wall surface.

Figure 14:
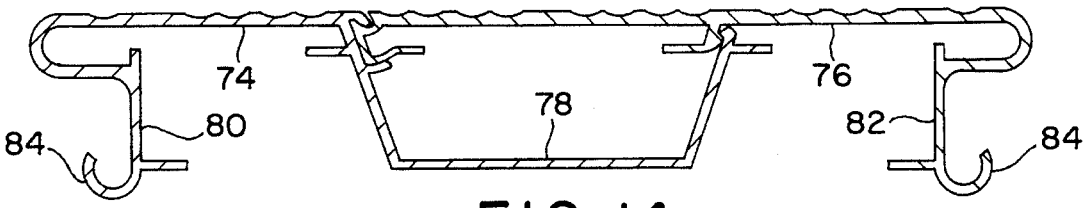
Figure 20:
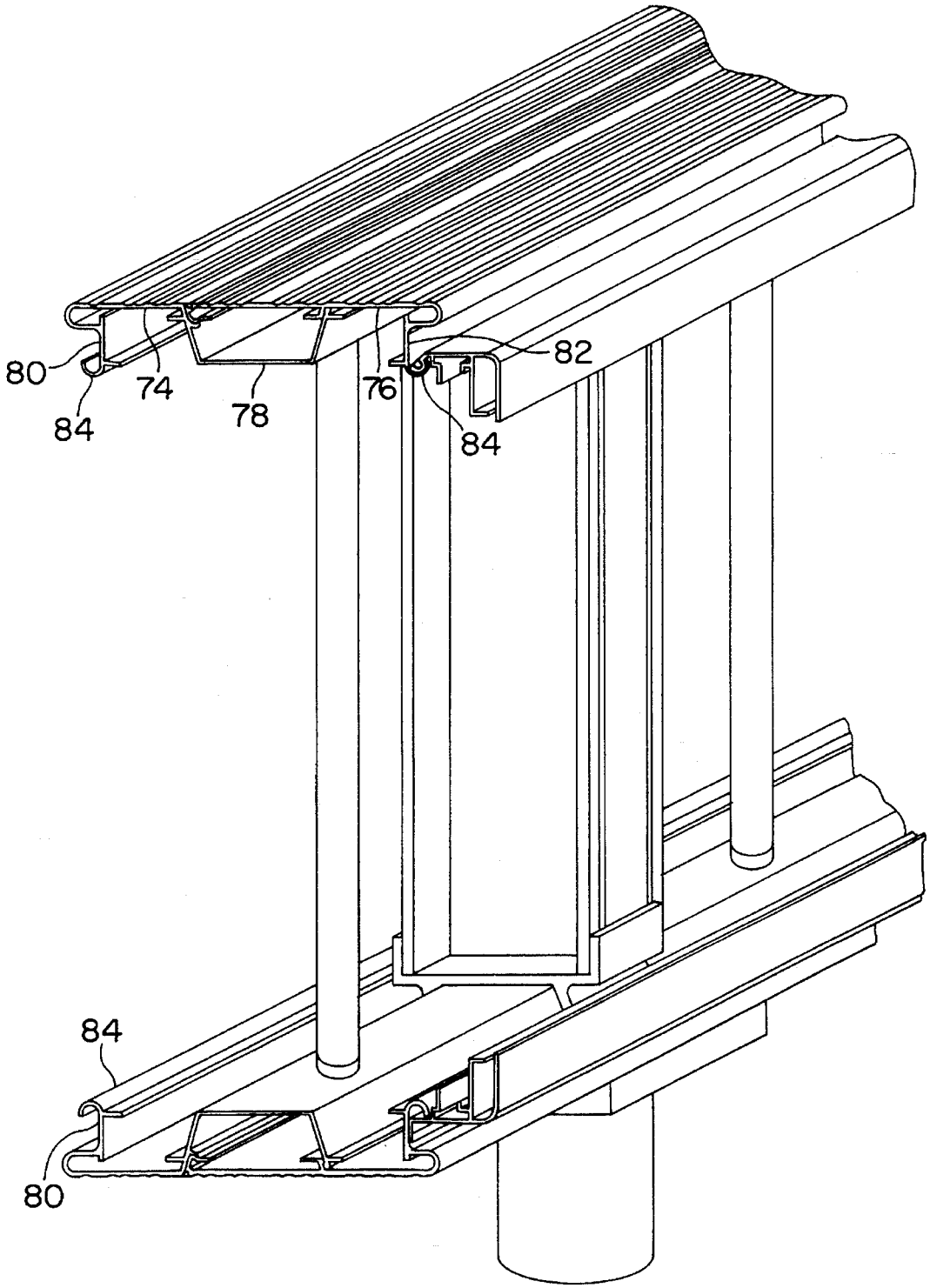
FIG. 20 illustrates a perspective view of an extruded sign frame such as shown in FIG. 14 with an attachment as shown in FIG. 9 secured thereto.

FIG. 14 illustrates a two-piece extruded sign frame 74, 76 in which the section 74 includes a column 78, that interlocks with the frame piece 76. The pieces 74 and 76 are provided with end faces 80, 82 each of which are provided with a flange 84. Separate sign faces can be supported on the flanges 84. The sign frame is illustrated in FIG. 20.

Figure 15:
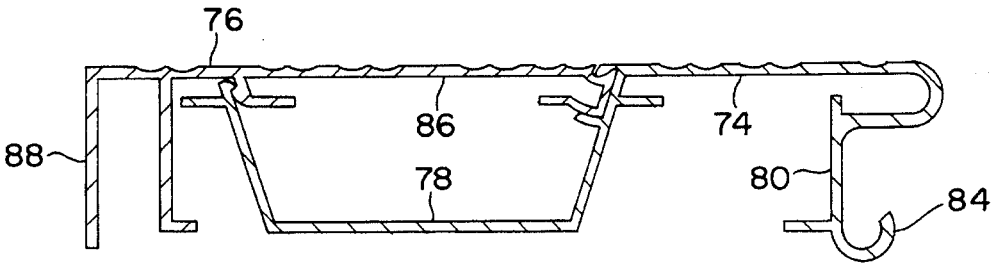
Figure 21:
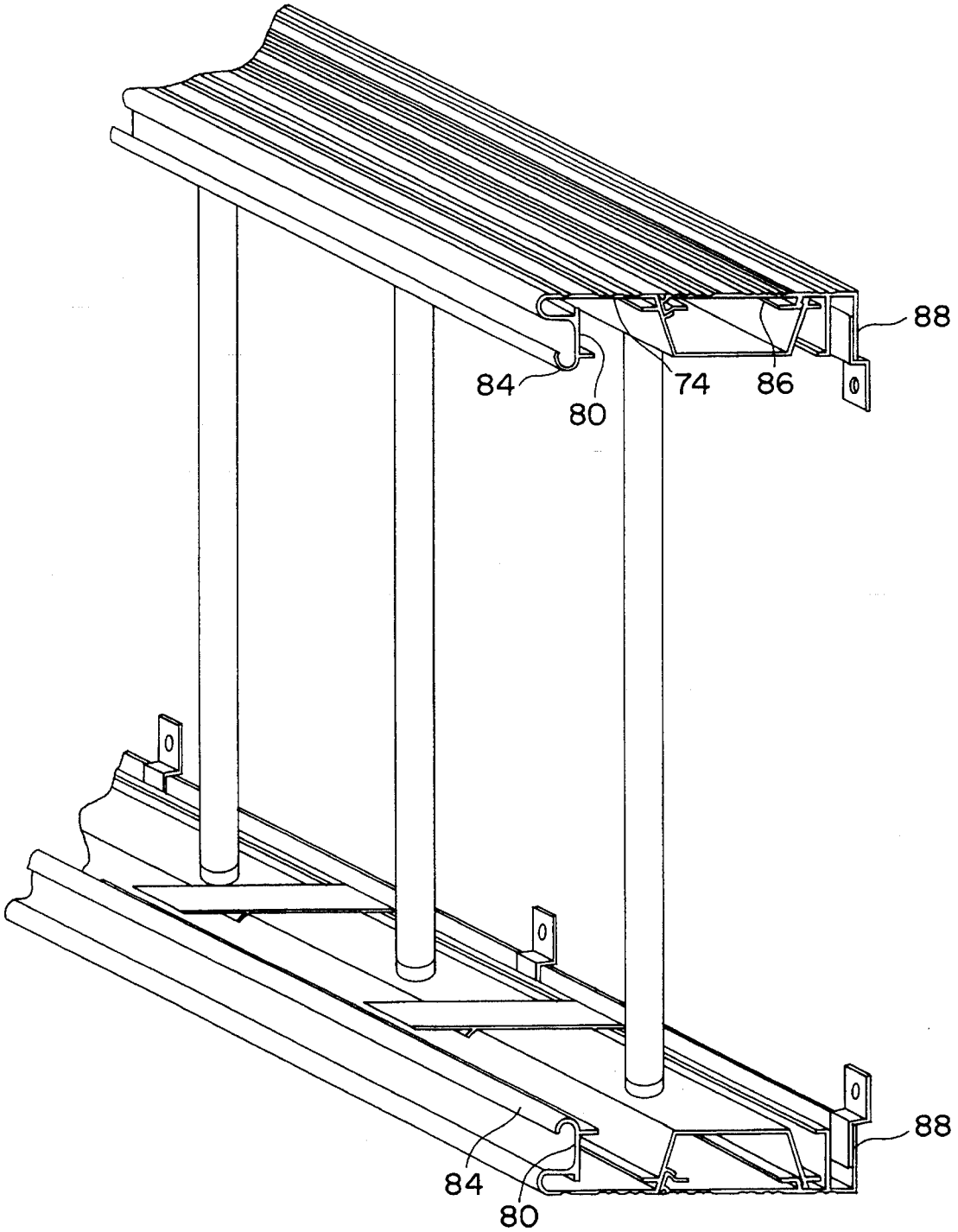
FIG. 21 illustrates an extruded sign frame such as shown in FIG. 16.

FIG. 15 illustrates a two-piece extruded sign frame 74, 86 in which the end 86 has a flat end 88 that can be secured flush with a wall. Such a sign frame is shown in FIG. 21.

FIGS. 16–21 illustrate some of the extruded sign frames, attachments etc., illustrated in FIGS. 1–15 which are shown in use as a sign.

FIG. 16 illustrates the attachment 26 shown in FIG. 5 secured to a known sign frame 89 with an extruded sign frame as shown in FIG. 8 secured to the attachment. A rigid sign facing 90 is shown secured between the two sign frames 39.

FIG. 17 illustrates an attachment 26 as shown in FIG. 5 secured to a known sign frame with an extruded sign frame 52 secured onto the flange of the sign attachment 26.

FIG. 18 illustrates an attachment 24 as shown in FIG. 4 secured to a known sign frame with an extruded sign frame 52 as shown in FIG. 11 secured to the attachment.

FIG. 19 illustrates a sign frame secured to a center pole or pipe. A C-Channel frame 40 such as shown in FIG. 7 is secured to the frame and any type of sign frame having a flange that mates with the flange 44 can be secured to the C-Channel frame 40.

FIG. 20 illustrates a sign formed by upper and lower extruded two piece sign frames such as set forth in FIG. 14. A rigid radiused extruded sign frame 39 as shown in FIG. 8 is secured to each of upper and lower two piece frames. Only one Side of the sign is shown with the sign frames 39 secured thereto. Obviously the opposite side could be provided by like sign frames.

FIG. 21 illustrates a sign which is secured at its back side to a backing surface. A two piece extruded frame as set forth in FIG. 15 can be provided at the upper and lower sides of the sign. Any type of extruded frame provided with a mating flange can be secured onto the flanges 84 at the top and secured at the bottom. As seen in FIGS. 18, 20 and 22, the U-shaped portion at the upper portion of the sign face structures shown in FIGS. 1, 3, 4 and 6 provide a covering for the somewhat semi-circular flange and also adds to the appearance to avoid a straight line face.

The sign structure shown in the foregoing figures includes a frame produced from extruded aluminum bar stock having an integral flange means. This extruded bar has a cross-section shape which, when it is assembled to form the frame for a sign face, provides flanges that in a final form produce a rigid box like structure of the body of the sign. One of the integral flange means on the assembled body faces inwardly from the periphery of the frame and forms a support for a translucent cover for displaying the message carried by the sign whereas other designs provide receiver grooves to accept tensioning apparatus for the insertion of tension connections utilized with flexible face sign substrates. A flange means on the other side of the body of the sign as shown in FIG. 21 protrudes from the periphery and is adapted to be attached to suitable support means such as the wall of a building. The connection assembly is made up of two parts, a top weight bearing semi-circular rail or flange to be attached to a wall or sign frame or a semi-circular feature made as part of a base Sign frame. The top portion of the face frame incorporates matching semi-circular features to allow the assembled face frame to be lifted up and hung on the receiver thereby improving or decreasing installation time and thereby decreasing cost. Once the assembled face frame is hung on the receiver, then the sides and bottoms may be attached back against the building structure or attached to a plurality of structures including existing sign frames either single sided or multiple sided. The sign may be illuminated by means of a light source placed within the body of the sign or by other means for directed light from a suitable source against the sign.

In carrying out the invention a person selects and installs a retrofit flush wall receiver to a standard sign or frame of any vintage or attaches a flush wall receiver to a wall or supporting structure on which the retrofit apparatus will fit. As an alternative to a retrofit shape shown in FIGS. 1–5, the person may select any frame design shown in FIGS. 6, 7 and 12–15 fabricated to form a desired size.

The person can select a face frame shape from different extrusions as shown in FIGS. 8–11. The face frames may be fabricated in the same manner as the base frame. The fabricated perimeters are then considered as standard in the sign industry. Once the attachments and face frames have been selected a rigid or flexible facing system is installed onto the fabricated face frame.

The assembled face frame with face installed is then hung on the flange or semi-circular receiver which holds the assembly in place while the sides and bottom are secured with a mechanical fastener of choice.

FIGS. 19–21 show typical cross sections of two variations of framing selected from FIGS. 6, 7 and 12–15, two for use with a center pole, one for a flush wall. FIGS. 22 and 12 depict a bullnose frame and a flush frame. FIG. 22 is similar in construction to FIG. 28, however, less expensive to build due to less extrusions, although the appearance is the same. FIG. 23 is also shown in FIG. 19 as a cross section. The finished look features flush retainers as opposed to step down retainers. The enclosures depict five versions of retrofit or wall mount combinations and six members of base frames with four different face retainer options. Hence, the total combination shown includes forty-four versions of sign structure which can be formed from use of the sign attachments and sign frames.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A sign facing attachment for securing to a sign frame and from which an intermediate element holding a sign facing may be hung which comprises an elongated extruded one piece body, said elongated extruded one piece body comprising a body portion having a straight main body section having a first side and a second site and a protruding non-straight receiver end integral with a first end of said straight main body section and protruding outwardly of said first side, a U-shaped body portion that includes an open end and a curved closed end integrally connected between first and second side portions of the U-shaped body portion, said first and second side portions of said U-shaped body portion being substantially parallel with each other, with one end of said first side portion of said U-shaped body portion integral with a second end of said straight main body section of said body portion and protruding in a direction outwardly of said first side of said straight main body section and in a same direction from said first side of said straight main body section as said protruding receiver end, and said second side portion of said U-shaped body portion is spaced from said first side portion of said U-shaped portion and spaced from said second end of said straight main body section and said second side portion of said U-shaped body portion has a free end extending in a direction opposite to that of said protruding receiver end, said second side portion of said U-shaped body portion being spaced further from the protruding receiver end than the first side portion of said U-shaped body portion, and an opening of said U-shaped body portion is seen from a direction toward said second side of said main body portion, said U-shaped body portion and said protruding receiver end extend outwardly from said first side of said straight main body portion, said protruding receiver end has a first inner wall and a second outer wall, said first inner wall defining a non-straight opening oriented toward said U-shaped, body portion, said first inner wall defining said opening adapted to receive a complementally shaped flange of said intermediate element for holding said sign facing, whereby said sign facing attachment can be secured to a supporting structure and said intermediate element hung on said sign facing receiver end for supporting a sign facing.

2. A sign facing attachment as set forth in claim 1 wherein said second side portion of said U-shaped body portion includes a straight extension (28) having a straight free end that extends beyond said second side of said straight main body section in a direction relative to said second side of said straight main body section opposite from said closed end of said U-shaped body portion.

3. A sign facing attachment as set forth in claim 1 in which said sign facing receiver end is semicircular in cross section.

4. A sign facing attachment as set forth in claim 1, wherein said second side portion of said U-shaped body portion includes a straight extension (21) having a straight free end that extends in a same plane as said straight main body section in a direction away from said second end of said straight main body section.

5. A sign facing attachment as set forth in claim 1, in which said U-shaped body portion has an upward extending straight portion in a plane with said elongated main body section.

6. A sign facing attachment as set forth in claim 5, in which said main body section includes a support structure (36) which is integral with said straight main body section and which extends in a direction opposite from said sign facing receiver end.

7. A sign facing attachment as set forth in claim 6, in which said sign facing receiver end is semi-circular and said support structure is in alignment with said semi-circular sign facing receiver end.

8. A sign facing attachment as set forth in claim 1, in which said straight main body section includes a support structure (36) which extends in a direction opposite from said sign facing receiver end relative to said straight main body section.

* * * * *